US005983541A

United States Patent [19]

Shih

[11] Patent Number: 5,983,541

[45] Date of Patent: Nov. 16, 1999

[54] ORNAMENTAL WATER BALL

[76] Inventor: Barry Shih, 2F, No. 321, Pa Teh Rd., Sec. 4, Taipei, Taiwan

[21] Appl. No.: 09/036,553

[22] Filed: Mar. 6, 1998

[51] Int. Cl.[6] ..... G09F 19/00

[52] U.S. Cl. ..... 40/410; 40/725

[58] Field of Search ..... 40/409, 410, 406, 40/725

[56] References Cited

U.S. PATENT DOCUMENTS 5,090,144 2/1992 Liu ..... 40/410

5,110,636 5/1992 Hou ..... 40/410 X

*Primary Examiner*—Cassandra H. Davis

*Attorney, Agent, or Firm*—W. Wayne Liauh

[57] ABSTRACT

An ornamental water ball includes a semi-spherical ball horizontally mounted on a frame through a rubber seal. In the rubber seal, there is a transparent viewing window which has an article holder located herein. The ball is filled with water or a mixture of water and oil. The article holder may contain a variety of practical or decorative goods such as a clock or picture. The viewing window may also hold decorative figures. All the components are detachable and may be assembled or disassembled as desired. All decorative goods are changeable to add practicality and amusement effect.

10 Claims, 7 Drawing Sheets

ORNAMENTAL WATER BALL

BACKGROUND OF THE INVENTION

1. Field of the Invention

This invention relates to an ornamental water ball and particularly to a ornamental water ball that includes different changeable decorative articles.

2. Description of the Prior Art

Conventional ornamental water ball such as the one shown in FIG. 1 usually includes a spherical ball filled with water and mounted on a base seat. Inside the ball, there could be held a decorative article to increase amusement effect. The ball is fixed on the base seat at an opening by means of a water tight rubber seal. Since the ball is fixed to the base seat, the decorative article held inside is not changeable. It thus lacks variation and becomes not appealing or attractive after a short period of time.

SUMMARY OF THE INVENTION

In view of aforesaid disadvantage, it is therefore an object of this invention to provide an ornamental water ball which is constructed by detachable components so that the decorative article held therein may be changed whenever desired. It thus may greatly enhance its variation and amusement effect.

It is another object of this invention to provide an ornamental water ball which includes a viewing window and a magnifying lens to enlarge the image of the decorative article.

It is a further object of this invention to provide an ornamental water ball which allows oil and water to be filled therein so that more amusement effect may be created.

It is yet another object of this invention to provide an ornamental water ball which enables floatable decorative articles be held inside to further increase the amusement effect.

It is still another object of this invention to provide an ornamental water ball which includs a photo clip and an article holder in a viewing window so that it can be doubled as a photo frame.

It is a further object of this invention to provide an ornamental water ball which includes a clock in a viewing window so that it can doubled as a clock or alarm clock.

It is yet a further object of this invention to provide an ornamental water ball which includes a decorative board and a light source behind the decorative board so that it may further increase the amusement effect.

The ornamental water ball according to this invention includes a transparent semi-spherical ball mounted on a frame by means of a water tight rubber seal. The axis of the ball is about at a horizontal line. The rubber seal is substantially cylindrical. Within the rubber seal, there is a viewing window and a article holder. All of these components are detachable and may be assembled or disassembled whenever needed. Therefore the decorative articles held in the ball may be changed or replaced as desired to increase the practicality and amusement effects.

BRIEF DESCRIPTION OF THE DRAWINGS

The invention, as well as its many advantages, may be further understood by the following detailed description and drawings in which:

FIG. 4 is a sectional view of this invention.

DETAILED DESCRIPTION OF THE PREFERRED EMBODIMENT

Figure 1:
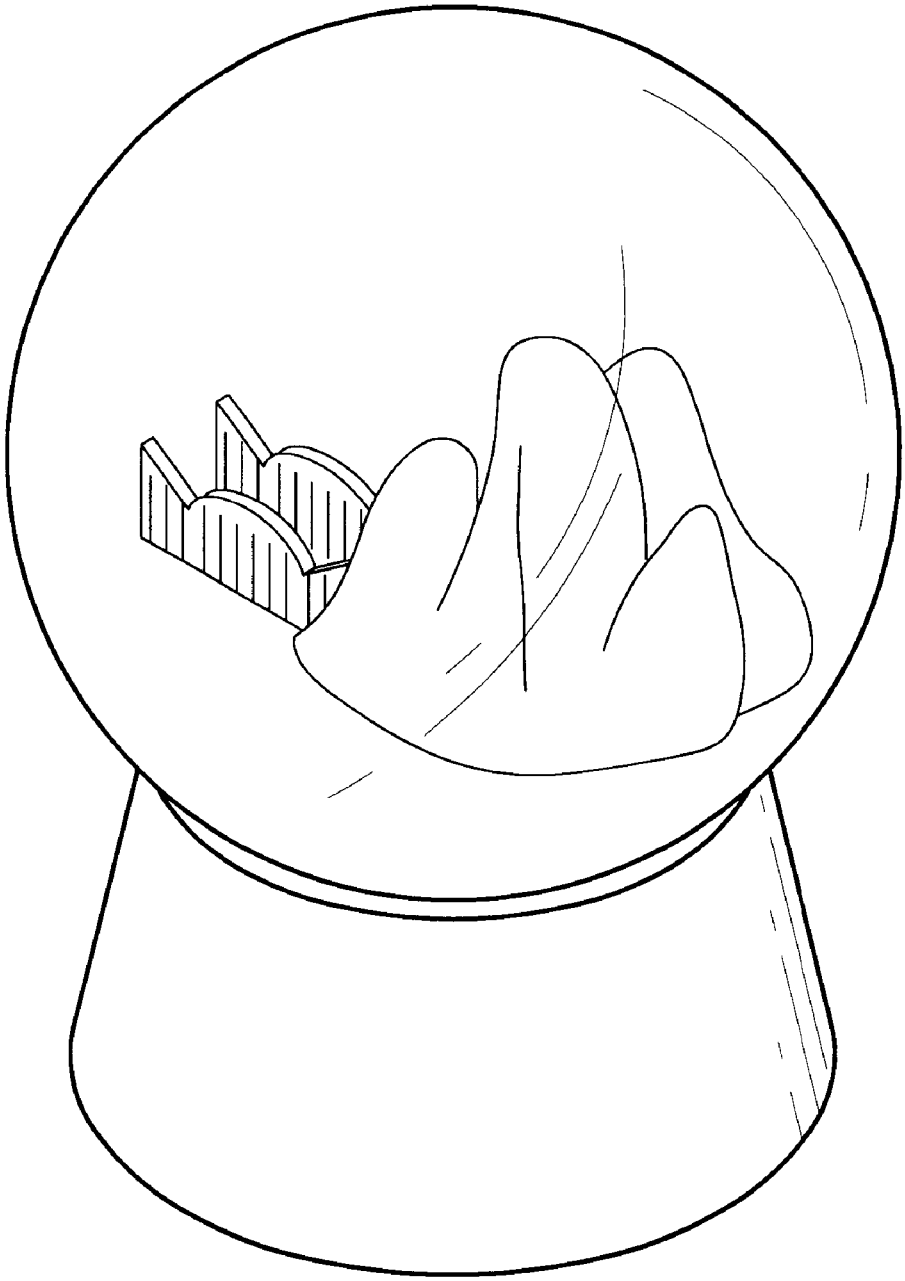
FIG. 1 (PRIOR ART)
FIG. 1 is a pictorial view of a conventional ornamental water ball.
Figure 2:
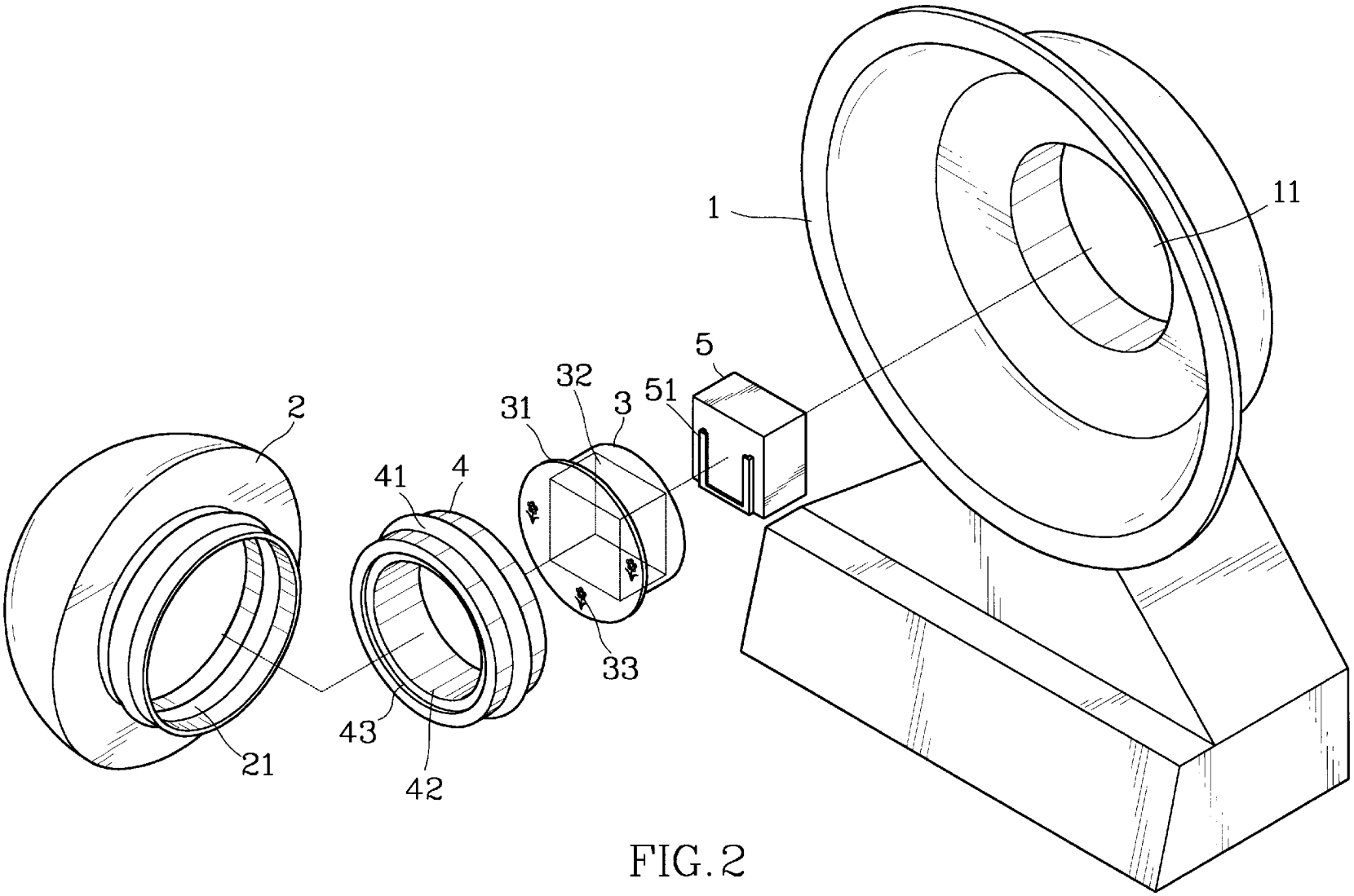
FIG. 2 is an exploded view of this invention.
Figure 3:
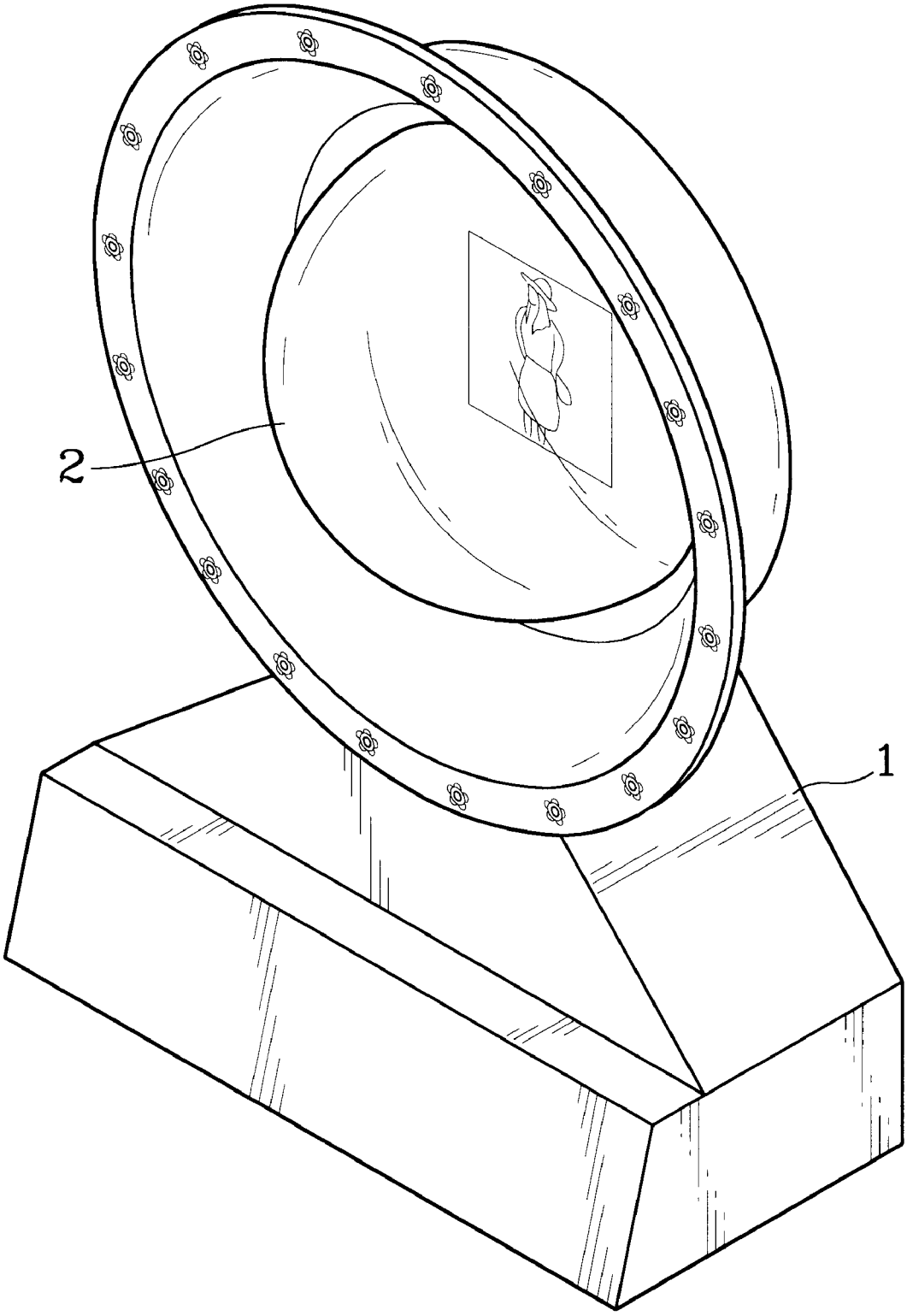
FIG. 3 is a perspective view of this invention.

Referring to FIGS. 2 and 3, this invention includes a frame 1, a semi-spherical ball 2 which is made of a transparent material such as glass or acrylic, a viewing window 3, a rubber seal 4 and an article holder 5.

Figure 4A:
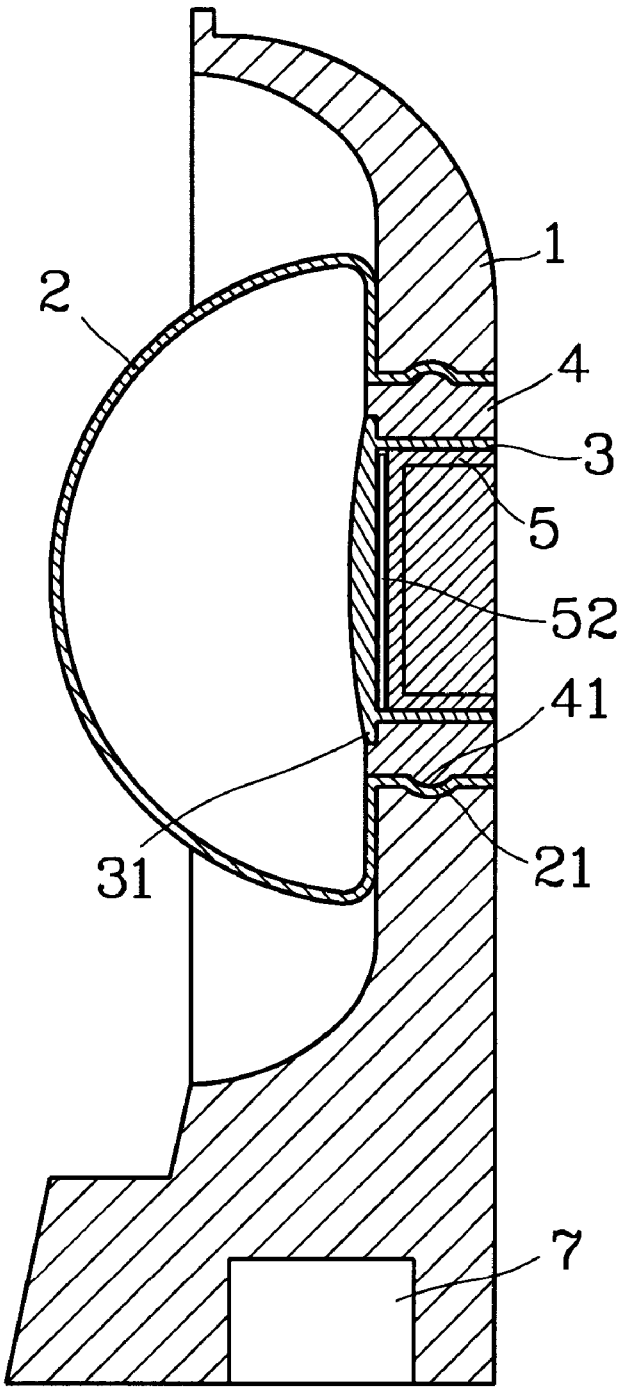
FIG. 4A is a sectional view of this invention with a magnifying lens.
Figure 4B:
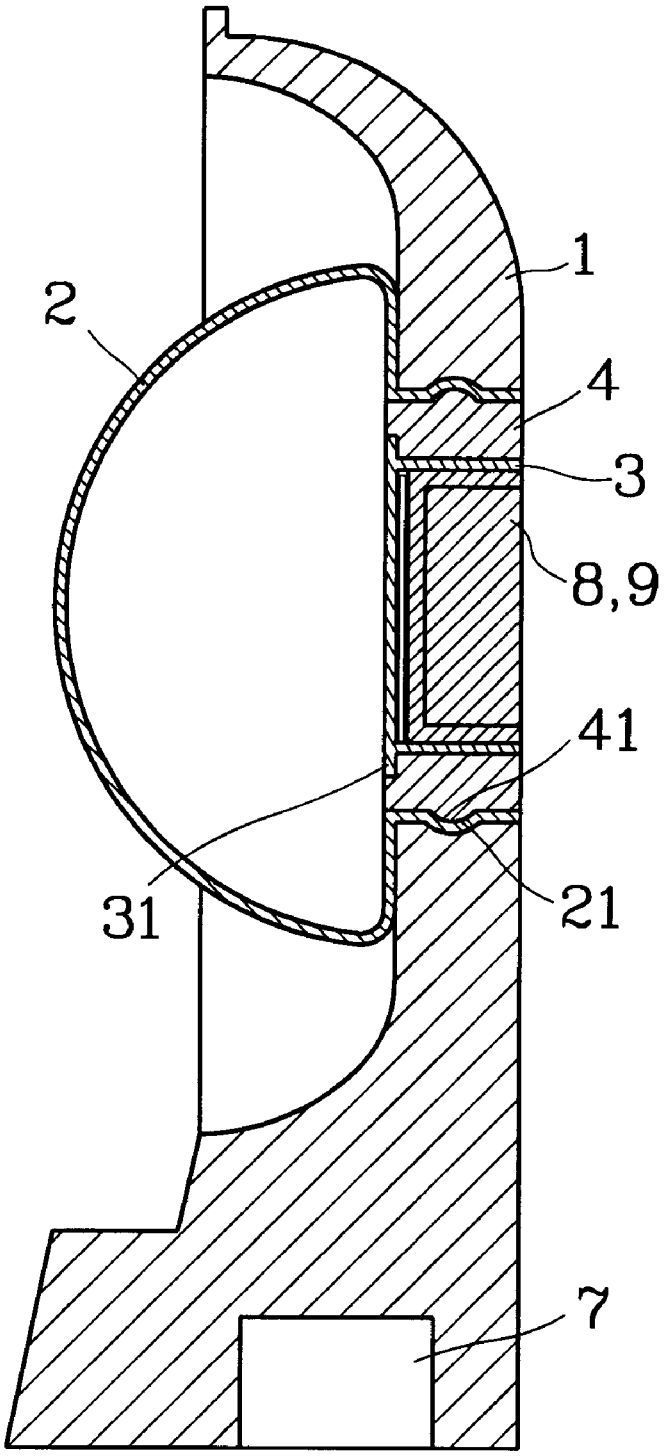
FIG. 4B is a sectional view of this invention with a clock or light.

The frame 1 has an annular ball seat 11 in a rear end, and a circular opening in the rear end center. The ball 2 has an annular flange in the rear side which has a concave annular trough 21 in the center circumference. The rubber seal 4 is cylindrically formed, has a round through bore 42 in the center and a protrusive annular ring 41 around the circumference. The rubber 5 seal 4 can engage tightly with the annular flange of the ball, and with the annular ring 41 engages tightly against the annular trough 21 (also shown in FIG. 4) to form a water-tight seal. The rubber seal 4 further has a step annular step groove 43 formed at a front end.

The viewing window 3 is made of transparent material, has a cylindrical body, a round disk 31 in the front, and a cavity 32 in the cylindrical body. The cylindrical body may be housed in the bore 42 while the disk 31 engages with the step groove 43 to form a water-tight seal. On the disk 31, there could be decorative FIGS. 33 embossed thereon. The article holder 5 is housed in the cavity 32 and may have a clip 51 located at a front end.

When in use, place the viewing window 3 in the bore 42 of the rubber seal 4, and put the ball 2 horizontally in the frame 1 with the rear flange housed in the circular opening of the frame. Then fill the ball 2 with desirable liquid. Afterward, wedge the rubber seal 4 into the opening formed by the 20 annular flange of the ball 2. A picture 52 may then be placed upon the clip 51. The article holder 5 with the picture then may be inserted into the cavity 32 of the viewing window 3. Then an enlarged picture may be seen from outside of the ball 2. It may serve as an ornamental item and a photo frame (shown in FIG. 3). The decorative FIGS. 33 also serve as another piece of amusement 25 goods. The disk 31 may also be formed like a magnifying lens (FIG. 4A) or a decorative board to enlarge the FIGS. 33 to further increase the amusement effect.

Figure 6:
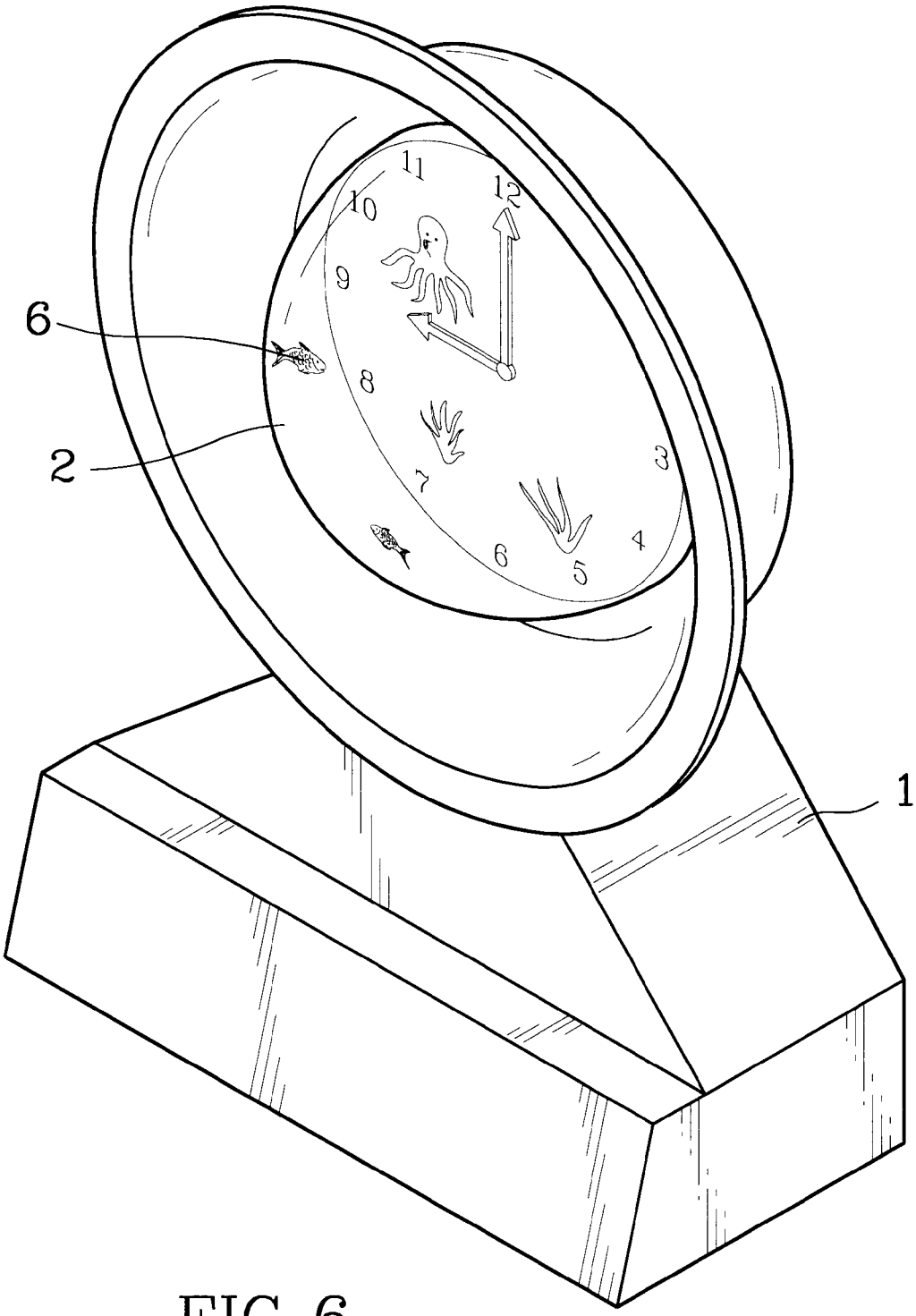
FIG. 6 is another embodiment of this invention.

The article holder 5 may be replaced by other practical or decorative article such as a photo frame (FIG. 3), clock 9 (FIG. 4B and 6), or light 8 (FIG. 6). It therefore can further increase the versatility and usefulness.

Liquid contained in the ball may also be a mixture of oil and water so that a wide variety of visual effects may be created.

Figure 5:
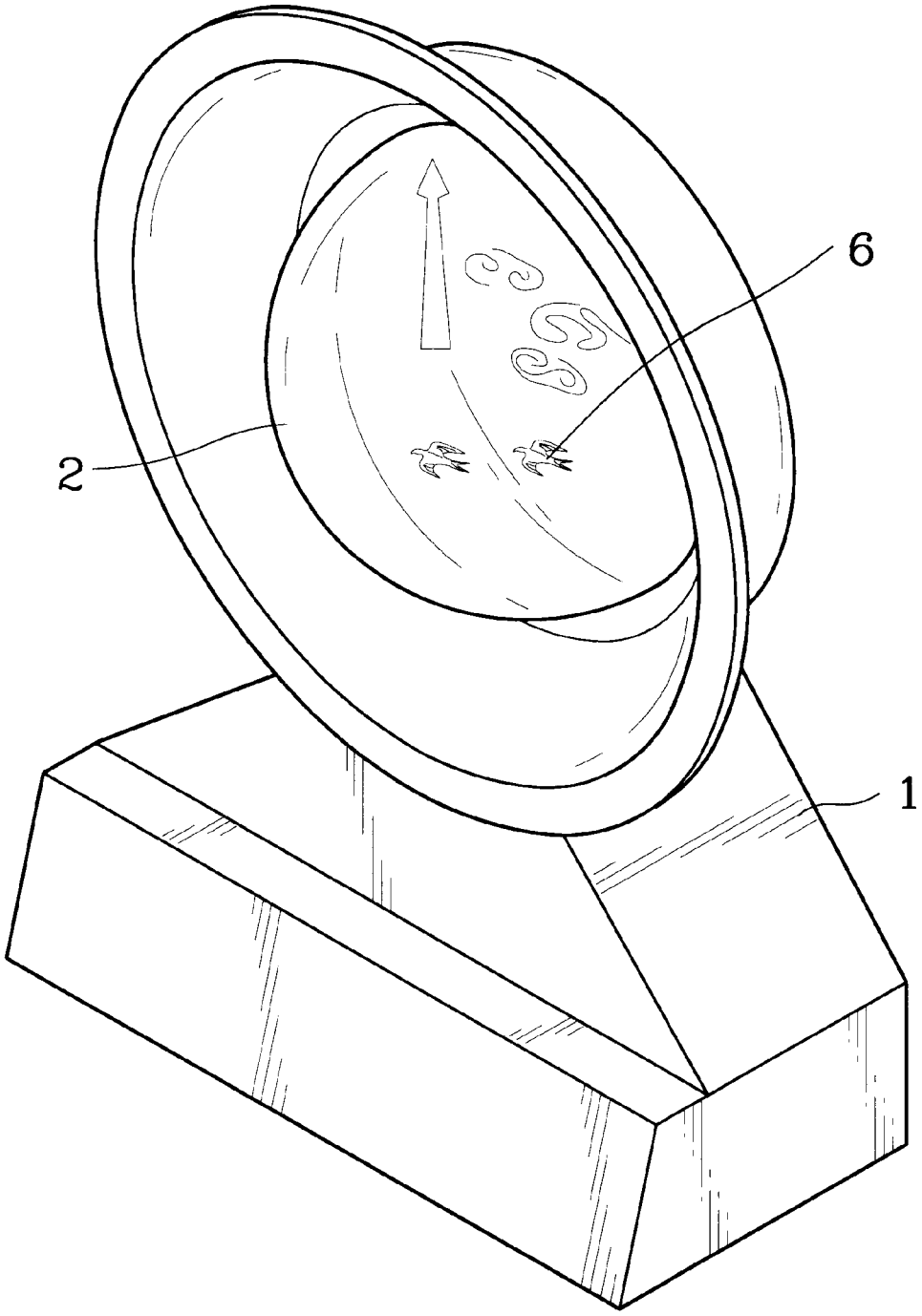
FIG. 5 is further embodiment of this invention.

Furthermore, floating decorative articles 6 (FIG. 5) may be included in the ball 2, or a musical means 7 may be included in the frame (FIG. 4A) to add more amusement effect or practical use.

It may thus be seen that the objects of the present invention set forth herein, as well as those made apparent from the foregoing description, are efficiently attained.

While the preferred embodiment of the invention has been set forth for purpose of disclosure, modifications of the disclosed embodiment of the invention as well as other embodiments thereof may occur to those skilled in the art. For example the shape of the ball 2 and the angular relationship between the ball 2 and the frame 1 may be varied in many other different forms desired. Accordingly, the appended claims are intended to cover all embodiments which do not depart from the spirit and scope of the invention.

What is claimed is:

1. An ornamental water ball comprising:

a frame having a ball seat, the ball seat having an opening in a center of the ball seat;

a semi-spherical ball filled will transparent liquid having an annular flange in a rear end, the annular flange engageable with the opening of the frame horizontally having an annular concave trough on a circumference of the semi-spherical ball;

a cylindrical rubber seal having a through bore, an annular ring engageable with the concave trough and an annular step groove at a front end;

a viewing window made of a transparent material engageable with the bore of the rubber seal having a cavity inside and a round disk at a front end mating with the step groove; and an article holder housed in the cavity.

2. An ornamental water ball of claim 1, which further comprises a round disk in front of the cavity.

3. An ornamental water ball of claim 2, wherein the round disk in front of the cavity has decorative figures disposed thereon.

4. An ornamental water ball of claim 2, wherein the round disk is concave in shape.

5. An ornamental water ball of claim 1, wherein the liquid is a mixture of water and oil.

6. An ornamental water ball of claim 1, wherein the ball contains floating articles in the liquid.

7. An ornamental water ball of claim 1, wherein the article holder further has a clip at a front end.

8. An ornamental water ball of claim 1, wherein the cavity contains a clock.

9. An ornamental water ball of claim 1, wherein the cavity contains a light source article.

10. An ornamental water ball of claim 1, wherein the frame further includes a musical means.

* * * * *